US008543029B2

(12) United States Patent
Mizusawa

(10) Patent No.: US 8,543,029 B2
(45) Date of Patent: Sep. 24, 2013

(54) IMAGE FORMING APPARATUS, IMAGE FORMING METHOD, AND PROCESS CARTRIDGE FOR ADJUSTING APPLICATIONS OF LUBRICANTS

(75) Inventor: Hiroshi Mizusawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 348 days.

(21) Appl. No.: 12/923,299

(22) Filed: Sep. 14, 2010

(65) Prior Publication Data

US 2011/0064452 A1 Mar. 17, 2011

(30) Foreign Application Priority Data

Sep. 15, 2009 (JP) ..... 2009-213362

(51) Int. Cl.
*G03G 15/16* (2006.01)

(52) U.S. Cl.
USPC ..... 399/101; 399/346

(58) Field of Classification Search
USPC ..... 399/98, 101, 346
See application file for complete search history.

(56) References Cited

U.S. PATENT DOCUMENTS

| | | | | |
|---|---|---|---|---|
| 7,313,347 | B2 | 12/2007 | Shintani et al. | |
| 2003/0007806 | A1 * | 1/2003 | Kayahara | |
| 2005/0042534 | A1 * | 2/2005 | Tanaka et al. | |
| 2006/0039726 | A1 | 2/2006 | Shintani et al. | |
| 2007/0068738 | A1 | 3/2007 | Kawahara et al. | |
| 2007/0127960 | A1 * | 6/2007 | Yoshida | 399/346 |
| 2008/0069615 | A1 * | 3/2008 | Shintani et al. | 399/346 |
| 2008/0096116 | A1 * | 4/2008 | Utsumi et al. | |
| 2009/0010693 | A1 * | 1/2009 | Hatori et al. | 399/346 |

FOREIGN PATENT DOCUMENTS

| | | | |
|---|---|---|---|
| JP | 05204183 | A * | 8/1993 |
| JP | 2000162881 | A | 6/2000 |
| JP | 2002023447 | A | 1/2002 |
| JP | 2002287567 | A | 10/2002 |
| JP | 2007286322 | A | 11/2007 |
| JP | 2008233238 | A | 10/2008 |

OTHER PUBLICATIONS

Japanese Office Action dated Jun. 13, 2013 for corresponding Japanese Application No. 2009-213362.

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

An image forming apparatus includes multiple image bearing members provided in tandem, multiple developing devices configured to develop the respective electrostatic latent images, an intermediate transfer member onto which the multiple toner images are transferred to form a composite toner image, multiple first lubricant applicators configured to apply a lubricant to the respective image bearing members, and a second lubricant applicator configured to apply a lubricant to the intermediate transfer member. The second lubricant applicator is provided upstream from the extreme upstream image bearing member. The amount of the first lubricant applied from the extreme upstream first lubricant applicator to the extreme upstream image bearing member is based on at least one of an amount of the second lubricant applied from the second lubricant applicator to the intermediate transfer member and an amount of first lubricant applied from each of the other lubricant applicators to the respective image bearing members.

19 Claims, 7 Drawing Sheets

IMAGE FORMING APPARATUS, IMAGE FORMING METHOD, AND PROCESS CARTRIDGE FOR ADJUSTING APPLICATIONS OF LUBRICANTS

CROSS-REFERENCE TO RELATED APPLICATIONS

The present patent application claims priority pursuant to 35 U.S.C. §119 from Japanese Patent Application No. 2009-213362, filed on Sep. 15, 2009, which is hereby incorporated by reference herein in its entirety.

BACKGROUND

1. Field of the Invention

The present invention relates to an image forming apparatus and a process cartridge including multiple image bearing members provided in tandem in the image forming apparatus, and an image forming method using multiple image bearing members provided in tandem.

2. Description of the Background

An electrophotographic image forming apparatus generally includes a photoreceptor that bears electrostatic latent images. A surface of the photoreceptor is charged by electric discharge, and the charged surface is then exposed to light containing image information to form an electrostatic latent image thereon. The electrostatic latent image is supplied with toner particles to be developed into a toner image that is visible. The toner image is transferred from the photoreceptor onto a recording material, and finally fixed thereon.

After transferring the toner image from the photoreceptor, some toner particles may remain on the photoreceptor. Such residual toner particles are generally removed by a cleaner so as not to adversely affect subsequent image forming operations. The cleaner may be a blade-shaped member comprised of an elastic material, such as rubber, contacted against a surface of the photoreceptor, for example.

In accordance with recent demand for higher image quality, toner particles are required to be much smaller and more spherical. Generally, small toner particles have an advantage in dot reproducibility, and spherical toner particles have an advantage in developability and transferability.

However, such small and spherical toner particles are difficult to manufacture through widely used conventional toner manufacturing processes including steps of kneading raw materials and pulverizing the kneaded raw material mixture into particles. On the other hand, toner manufacturing processes using polymerization reactions, such as suspension polymerization, emulsion polymerization, or dispersion polymerization, advantageously manufacture small and spherical toner particles. Such toner particles manufactured through polymerization processes are put into practical use recently.

However, small and spherical toner particles cause some problems when remaining on the photoreceptor after image transfer.

The first problem is that such small and spherical toner particles are difficult to remove from the photoreceptor using a blade-shaped member (hereinafter "a cleaning blade"). When the cleaning blade slidably contacts a surface of the photoreceptor to remove residual toner particles, the photoreceptor-contacting edge of the cleaning blade deforms due to frictional resistance between the cleaning blade and the photoreceptor, thus generating a tiny space or gap between the cleaning blade and the photoreceptor. Smaller toner particles are more likely to get into the tiny space, and more spherical toner particles are more likely to roll within the tiny space and pass through the cleaning blade. The more toner particles passing through the cleaning blade, the more the resulting image quality deteriorates.

The second problem is that release agents and fluidizing agents, included in the toner particles passed through the cleaning blade or remaining on the photoreceptor, are likely to gradually adhere to the surface of the photoreceptor, forming a thin film thereon. This phenomenon is hereinafter referred to as filming. Filming generally causes abnormal images such as solid images with white spots.

In attempting to satisfactorily remove small and spherical toner particles from photoreceptor, Japanese Patent Application Publication No. 2002-287567 (JP-2002-287567-A) proposes to decrease the surface friction coefficient of a photoreceptor by applying a lubricant (e.g., a metal soap of a fatty acid) to its surface to form a thin layer of the lubricant thereon.

Meanwhile, image forming apparatuses employing an intermediate transfer member are widely used recently. In such an image forming apparatus, multiple different-color toner images are sequentially formed on multiple photoreceptors, and then sequentially transferred onto an intermediate transfer member. This process is called a primary transfer process. In the primary transfer process, the different-color toner images are superimposed on one another on the intermediate transfer member, forming a composite full-color toner image. The composite full-color toner image is finally transferred onto a recording material. This process is called a secondary transfer process.

In both the primary and secondary transfer processes, some toner particles in the toner images may not be transferred, and therefore the resulting toner image on a recording material may have local defects. When a solid image has such defects, each defect may occupy a considerably large area. When a line image has defects, the line may be interrupted by the defects.

The composite full-color toner image comprised of four color toners is more likely to cause such defects than monochromatic images. The first reason for this is that the composite full-color toner image has considerable depth or thickness, and moreover, repeating the primary transfer process four times generates considerable non-Coulomb mechanical adhesive forces, other than electrostatic forces such as van der Waals force, between the toner and the photoreceptor or the intermediate transfer member. The second reason is that the adhesive force between the intermediate transfer member and the toner increases along with formation of an undesired film of the toner (i.e., filming).

In attempting to avoid production of such defects, JP-2000-162881-A proposes to apply an optimal amount of a lubricant to the surfaces of a photoreceptor and an intermediate transfer member to reduce the adhesive force between a toner and the photoreceptor or the intermediate transfer member. Although a successful approach, in a case in which multiple photoreceptors are arranged in tandem, the lubricant applied to the intermediate transfer member may be further retransferred onto the extreme upstream photoreceptor, supplying the extreme upstream photoreceptor with an excessive amount of lubricant.

The excessive amount of lubricant on the photoreceptor may excessively decrease the surface friction coefficient, resulting in too small an adhesive force between the photoreceptor and the toner. Thus, the toner cannot reliably adhere to an electrostatic latent image on the photoreceptor, resulting in a toner image with defects and a low density.

Additionally, there is another concern that the excessive amount of lubricant on the photoreceptor may contaminate the image forming apparatus charging roller, thereby producing images of uneven density.

SUMMARY

Exemplary aspects of the present invention are put forward in view of the above-described circumstances, and provide an image forming apparatus, an image forming method, and a process cartridge, each of which provides high-quality images.

In one exemplary embodiment, a novel image forming apparatus includes multiple image bearing members that bear respective electrostatic latent images, provided in tandem; multiple chargers that charges respective surfaces of the respective multiple image bearing members; an irradiator that emits light onto the charged surfaces of the multiple image bearing members to form respective electrostatic latent images thereon; multiple developing devices that develop the respective electrostatic latent images with toner to form respective toner images; an intermediate transfer member onto which the multiple toner images are transferred; multiple primary transfer members that transfer the respective toner images from the respective image bearing members onto the intermediate transfer member to form a composite toner image; a secondary transfer member that transfers the composite toner images from the intermediate transfer member onto a recording material; a cleaner that removes residual toner particles remaining on the intermediate transfer member after transferring the composite toner image therefrom; multiple first lubricant applicators that apply a lubricant to the respective image bearing members; and a second lubricant applicator that applies a lubricant to the intermediate transfer member, provided downstream from the cleaner and upstream from the extreme upstream image bearing member. In this image forming apparatus, the amount of lubricant applied from the extreme upstream first lubricant applicator to the extreme upstream image bearing member is smaller than that applied from each of the other lubricant applicators to the respective image bearing members.

In another exemplary embodiment, a novel image forming method includes: charging surfaces of multiple image bearing members that bear respective electrostatic latent images, the image bearing members provided in tandem; emitting light onto the charged surfaces of the multiple image bearing members to form respective electrostatic latent images thereon; developing the respective electrostatic latent images with toner to form respective toner images; transferring the multiple toner images onto an intermediate transfer member to form a composite toner image; transferring the composite toner images from the intermediate transfer member onto a recording material; removing residual toner particles remaining on the intermediate transfer member by a cleaner after transferring the composite toner image therefrom; applying a lubricant to each of the multiple image bearing members; and applying a lubricant to the intermediate transfer member downstream from the cleaner and upstream from the extreme upstream image bearing member. In this image forming method, the amount of lubricant applied to the extreme upstream image bearing member is smaller than that applied to each of the other image bearing members.

In further exemplary embodiment, a novel process cartridge detachably mountable on image forming apparatus includes multiple image bearing members that bear respective electrostatic latent images, provided in tandem; and multiple first lubricant applicators that apply a lubricant to the respective image bearing members. In this process cartridge, the amount of lubricant applied from the extreme upstream first lubricant applicator to the extreme upstream image bearing member is smaller than that applied from each of the other lubricant applicators to the respective image bearing members.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
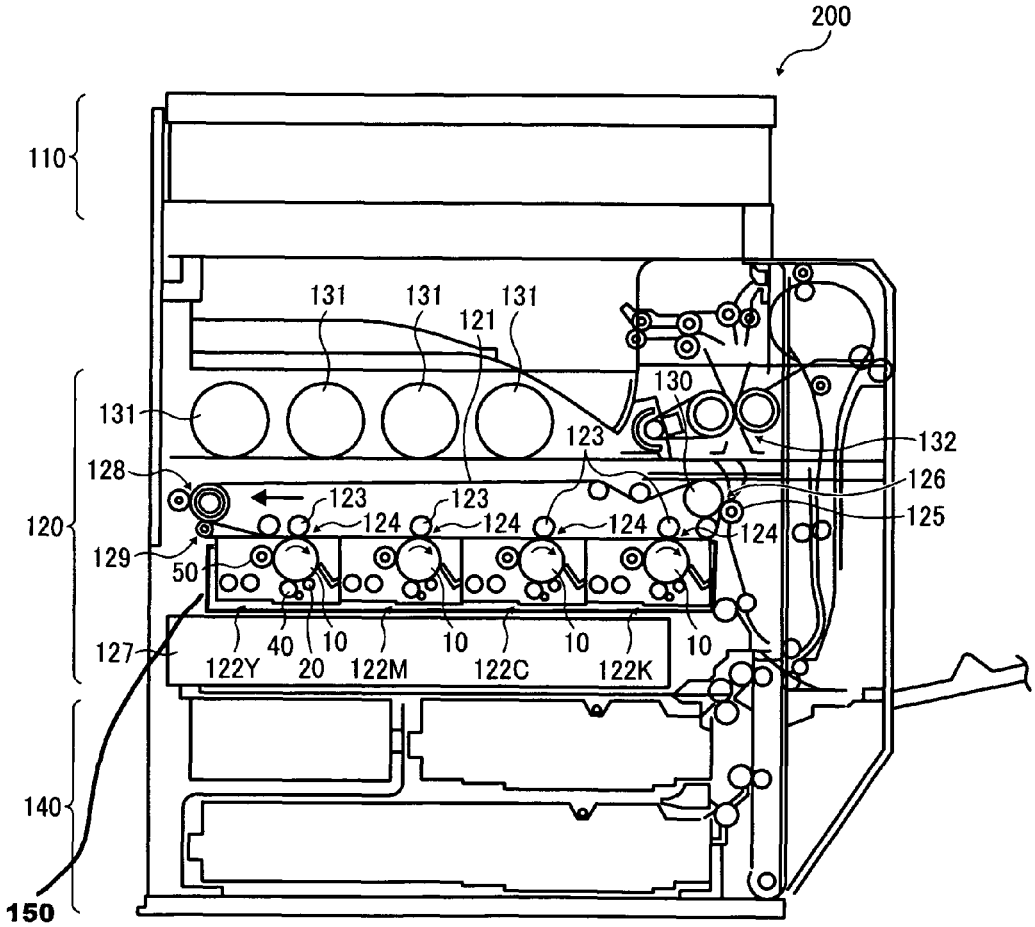
FIG. 1 is a schematic view illustrating an image forming apparatus according to this specification.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic view illustrating an image forming apparatus according to this specification. An image forming apparatus 200 illustrated in FIG. 1 includes a reading part 110 that reads image information of a document, an image forming part 120 that forms an image on a recording material based on the image information read by the reading part 110, and a paper feed part 140 that stores the recording material.

The image forming part 120 includes an intermediate transfer belt 121 that is an endless belt comprised of a heat-resistant resin, such as polyimide or polyamide. The intermediate transfer belt 12 is stretched taut with multiple rollers, and driven to rotate counterclockwise in FIG. 1. Below the intermediate transfer belt 121, process cartridges 122Y, 122M, 122C, and 122K containing respective toners of yellow, magenta, cyan, and black are arranged in tandem.

Because the process cartridges 122Y, 122M, 122C, and 122K have the same configuration, the additional characters Y, M, C, and K representing respective colors of yellow, magenta, cyan, and black are hereinafter added or omitted as appropriate.

Figure 2:
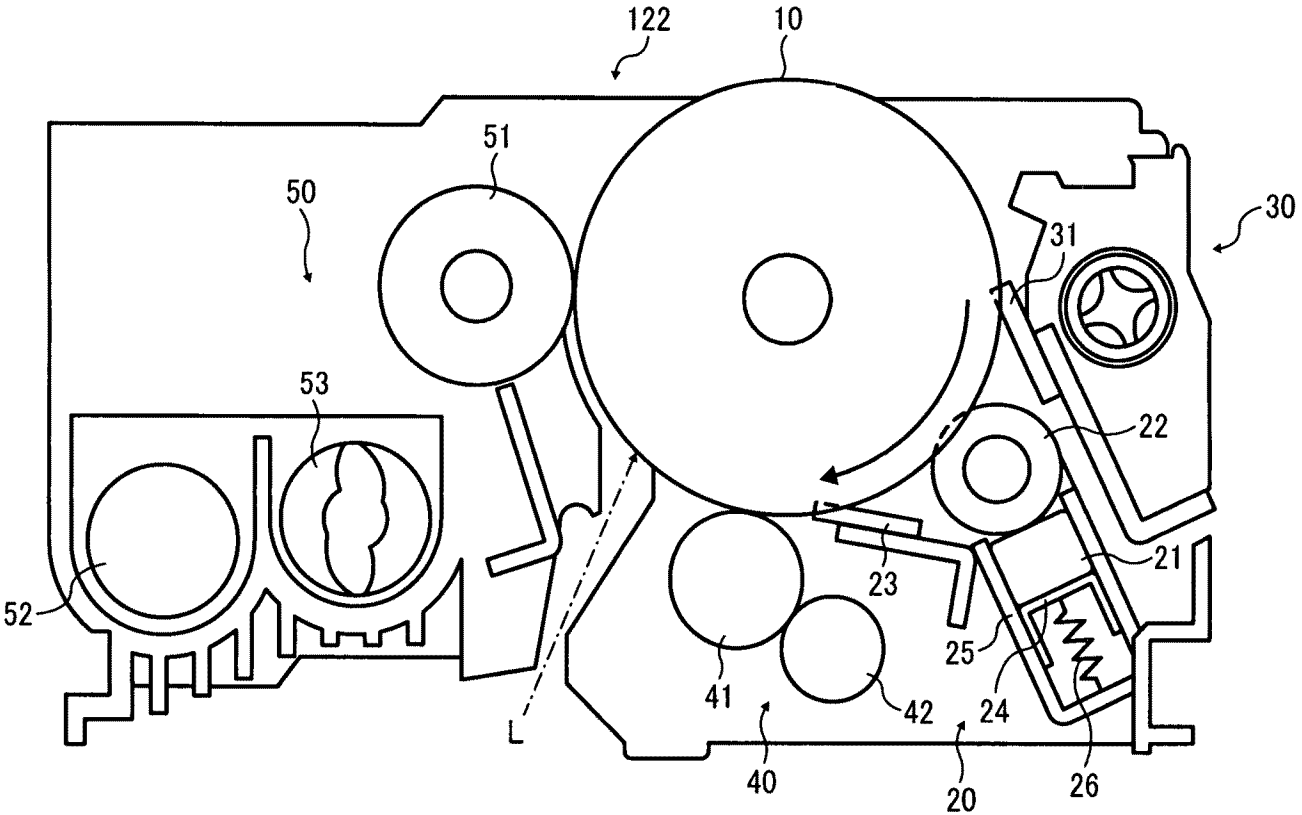
FIG. 2 is a magnified schematic view illustrating the process cartridge included in the image forming apparatus illustrated in FIG. 1.

FIG. 2 is a magnified schematic view illustrating the process cartridge 122.

The process cartridge 122 includes a photoreceptor 10. The photoreceptor 10 serves as an image bearing member that bears an electrostatic latent image on its surface. A lubricant applicator 20, a cleaner 30, a charger 40, and a developing device 50 are provided around the photoreceptor 10. The photoreceptor 10 is driven to rotate clockwise in FIG. 2 by a driving unit, not shown.

The lubricant applicator 20 serves as a first lubricant applicator that applies a lubricant to a surface of the photoreceptor 10. The lubricant applicator 20 includes a solid lubricant 21, a brush roller 22, and a blade 23. The brush roller 22 is driven to rotate while contacting both the solid lubricant 21 and the photoreceptor 10. The blade 23 contacts a surface of the photoreceptor 10 downstream from the brush roller 22 relative to the direction of rotation of the photoreceptor 10.

The solid lubricant 21 is supported by a lubricant supporter 24. Both the solid lubricant 21 and the lubricant supporter 24 are slidably stored within a lubricant holder 25. An elastic member 26 in compression state is provided between the lubricant supporter 24 and an inner bottom of the lubricant holder 25. The brush roller 22 gradually scrapes the solid lubricant 21 along rotation, while reducing the thickness of the solid lubricant 21. The brush roller 22 constantly contacts the solid lubricant 21 at a predetermined pressure regardless of the thickness of the solid lubricant 21 owing to an elastic force from the elastic member 26. Lubricant powders scraped from the solid lubricant 21 are then applied to a surface of the photoreceptor 10 along rotation of the brush roller 22. The blade 23 levels the thickness of the lubricant powder applied to the photoreceptor 10.

The elastic member 26 may have a configuration disclosed in United States Patent Application Publication No. 2007/0068738 A1, the disclosures thereof being incorporated herein by reference, for example.

In place of the brush roller 22 illustrated in FIG. 2, a pair of brush rollers contacting with each other may be provided between the solid lubricant 21 and the photoreceptor 10. In this case, one brush roller scrapes the solid lubricant 21, and another brush roller applies the scraped lubricant powders to the photoreceptor 10. During migration of the lubricant powders from one brush roller to another, the lubricant powders receive shear force generated from friction between the two brush rollers. As a result, the lubricant powders are advantageously pulverized into much smaller particles.

The cleaner 30 removes and collects residual toner particles remaining on a surface of the photoreceptor 10. The cleaner 30 includes a cleaning blade 31 being in contact with a surface of the photoreceptor 10. The cleaning blade 31 slidably contacts a surface of the photoreceptor 10 along rotation of the photoreceptor 10, thereby removing and collecting residual toner particles remaining thereon.

The charger 40 charges a surface of the photoreceptor 10. The charger 40 includes a charging roller 41 and a charging roller cleaner 42 that rotates while contacting the charging roller 41. The charging roller 41 is connected to a power source, not shown, for uniformly charging a surface of the photoreceptor 10. The charging roller cleaner 42 cleans a surface of the charging roller 41.

The developing device 50 supplies toner particles (i.e., a developer) to an electrostatic latent image formed on a surface of the photoreceptor 10, thus developing the electrostatic latent image into a toner image that is visible. The developing device 50 includes a developing roller 51 that rotates while contacting a surface of the photoreceptor 10, an agitation roller 52 that agitates a developer, and a supply roller 53 that supplies the agitated developer to the developing roller 51.

Referring back to FIG. 1, the image forming part 120 further includes four primary transfer rollers 123 each facing the respective photoreceptors 10 in the process cartridges 122. A lower surface of the intermediate transfer belt 121 is sandwiched by the four primary transfer rollers 123 and the four photoreceptors 10, and endlessly moves while contacting them. Primary transfer areas 124 are thus formed with each of the primary transfer rollers 123 and each of the photoreceptors 10 with the intermediate transfer belt 121 therebetween.

The image forming part 120 further includes a secondary transfer roller 125 that faces a roller 130 with the intermediate transfer belt 121 therebetween. A recording material passes between the secondary transfer roller 125 and a portion of the intermediate transfer belt 121 where supported with the roller 130, so that a toner image is transferred thereon. A secondary transfer area 126 is thus formed with the secondary transfer roller 125 and the roller 130 with the intermediate transfer belt 121 therebetween.

A writing unit 127 is provided below the process cartridges 122. The writing unit 127 serves as an irradiator that emits laser light onto the surfaces of the photoreceptors 10 based on image information read by the reading part 110, to form electrostatic latent images thereon.

The image forming part 120 further includes a cleaner 128 provided proximally to the intermediate transfer belt 121 and a lubricant applicator 129 provided downstream from the cleaner 128 relative to the direction of rotation of the intermediate transfer belt 121.

Figure 3:
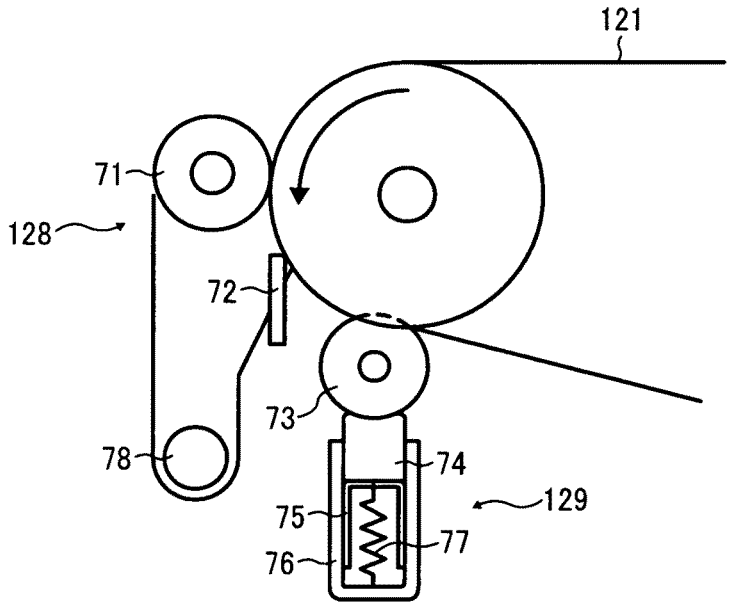
FIG. 3 is a magnified schematic view illustrating the cleaner and the lubricant applicator included in the image forming apparatus illustrated in FIG. 1.

FIG. 3 is a magnified schematic view illustrating the cleaner 128 and the lubricant applicator 129. The cleaner 128 includes a cleaning roller 71 and a cleaning blade 72 provided downstream from the cleaning roller 71 relative to the direction of rotation of the intermediate transfer belt 121. Both the cleaner 128 and the lubricant applicator 129 are in contact with the intermediate transfer belt 121. The cleaner 128 serves as an intermediate transfer member cleaner that removes residual toner particles and paper powders adhering to a surface of the intermediate transfer belt 121. Such residual toner particles and paper powders removed by the cleaner 128 are fed to a waste toner container, not shown, by a feed screw 78.

The lubricant applicator 129 serves as a second lubricant applicator that applies a lubricant to the intermediate transfer belt 121. The lubricant applicator 129 includes a brush roller 73 being in contact with the intermediate transfer belt 121, a solid lubricant 74 being in contact with the brush roller 73, a lubricant supporter 75 that supports the solid lubricant 74, a lubricant holder 76 that slidably stores the solid lubricant 74 and the lubricant supporter 75, and an elastic member 77 in compression state provided between the lubricant supporter 75 and an inner bottom of the lubricant holder 76. The brush roller 73 gradually scrapes the solid lubricant 74 along rotation, while reducing the thickness of the solid lubricant 74. The brush roller 73 constantly contacts the solid lubricant 74 at a predetermined pressure regardless of the thickness of the solid lubricant 74 owing to an elastic force from the elastic member 77. Lubricant powders scraped from the solid lubricant 74 are then applied to a surface of the intermediate transfer belt 121 along rotation of the brush roller 73. The elastic member 77 may have the same configuration as the elastic member 26 illustrated in FIG. 2, for example.

Referring back to FIG. 1, the image forming part 120 further includes four toner bottles 131 that supply toner particles to the respective process cartridges 122, and a fixing unit 132 that fixes a toner image on the recording material.

Operations of the image forming apparatus 200 are described below.

Referring to FIG. 2, the photoreceptor 10 in the process cartridge 122 is driven to rotate clockwise. First, the charging roller 41, to which a voltage is applied, charges a surface of the photoreceptor 10 to a predetermined polarity. An optically modulated laser light beam L is them emitted onto the charged surfaces of the photoreceptors 10 from the writing unit 127 illustrated in FIG. 1 to form an electrostatic latent image thereon. The developing roller 51 then supplies toner particles to the electrostatic latent image. Thus, the electrostatic latent image formed on each of the photoreceptors 10 is developed into a toner image of each color.

Referring back to FIG. 1, the primary transfer rollers 123, to which a transfer voltage is applied, sequentially transfer the toner images from the photoreceptors 10 onto the intermediate transfer belt 121 that is rotating, to form a composite full-color toner image thereon. The composite full-color toner image is then fed to the nip between the intermediate transfer belt 121 and the secondary transfer roller 125, and transferred onto the recording material fed from the paper feed part 140 in synchronization with an entry of the composite full-color image into the nip. The recording material having the composite full-color image thereon is then fed to the fixing unit 132, and the composite full-color image is fixed on the recording material by application of heat and pressure. The recording material on which the composite full-color toner image is fixed is discharged by discharge rollers to a discharge tray atop the image forming apparatus 200.

Residual toner particles remaining on the photoreceptor 10 after primary transfer are removed and collected by the cleaning blade 31, as illustrated in FIG. 2. Subsequently, the lubricant applicator 20 applies lubricant to the cleaned surface of the photoreceptor 10.

Residual toner particles remaining on the intermediate transfer belt 121 after secondary transfer are conveyed to the cleaner 128 along rotation of the intermediate transfer belt 121, and removed and collected by the cleaning roller 71 and the cleaning blade 72, as illustrated in FIG. 3. Subsequently, the lubricant applicator 129 applies lubricant to the cleaned surface of the intermediate transfer belt 121.

In the image forming apparatus 200, the amount of lubricant applied to the photoreceptor 10 from the lubricant applicator 20 depends on the elastic force (or pressing force) from the elastic member 26 (or the spring member) to the brush roller 22. The pressing force can be set as follows so that the lubricant is optimally applied to the photoreceptor 10.

Figure 4:
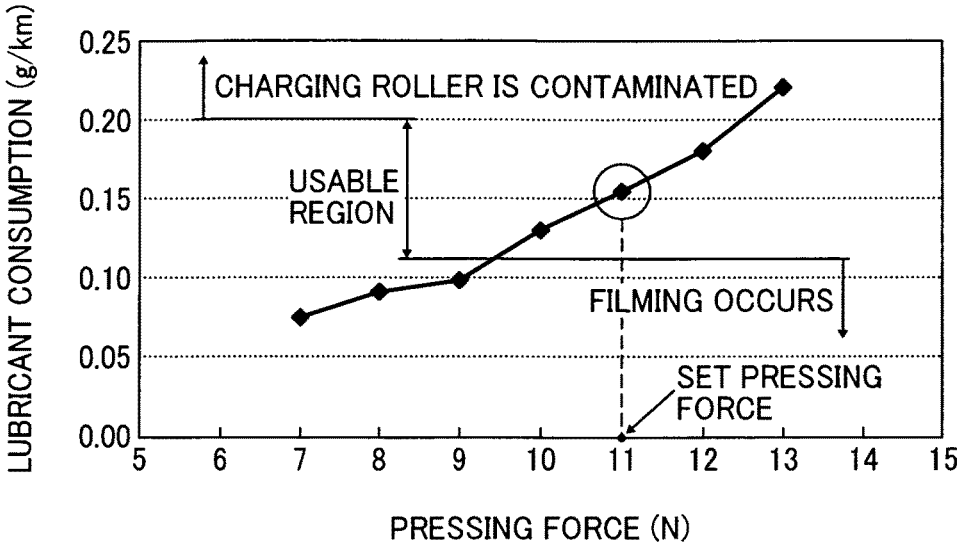
FIG. 4 is a graph showing a relation between the pressing force from the spring member in the lubricant applicator illustrated in FIG. 2 and the consumption (i.e., applied amount) of the solid lubricant illustrated in FIG. 2.

FIG. 4 is a graph showing a relation between the pressing force from the spring member in the lubricant applicator 20 and the consumption (i.e., applied amount) of the solid lubricant 21. FIG. 4 shows that the greater the pressing force, the greater the consumption of the solid lubricant 21. When the lubricant consumption is too small, filming occurs at a surface of the photoreceptor 10. When the lubricant consumption is too large, the charging roller 41 is contaminated with the lubricant. Therefore, preferably, the minimum lubricant consumption is equal to a consumption below which filming occurs, and the maximum lubricant consumption is equal to a consumption above which the charging roller is contaminated. FIG. 4 shows that filming occurs when the lubricant consumption is 0.11 g/km or less, and the charging roller is contaminated when the lubricant consumption is 0.2 g/km or more. In such a case, the minimum and maximum lubricant consumptions are preferably equal to 0.11 g/km and 0.2 g/km, respectively. Accordingly, the pressing force is set so that the lubricant consumption ranges between 0.11 and 0.2 g/km. More specifically, the pressing force is set to 11 N, at which the lubricant consumption is intermediate between 0.11 g/km and 0.2 g/km, i.e., approximately 0.155 g/km.

Similarly, the amount of lubricant applied to the intermediate transfer member 121 from the lubricant applicator 129 depends on the elastic force (or pressing force) from the elastic member 77 (or the spring member) to the brush roller 73. The pressing force can be set as follows so that the lubricant is optimally applied to the intermediate transfer member 121.

Figure 5:
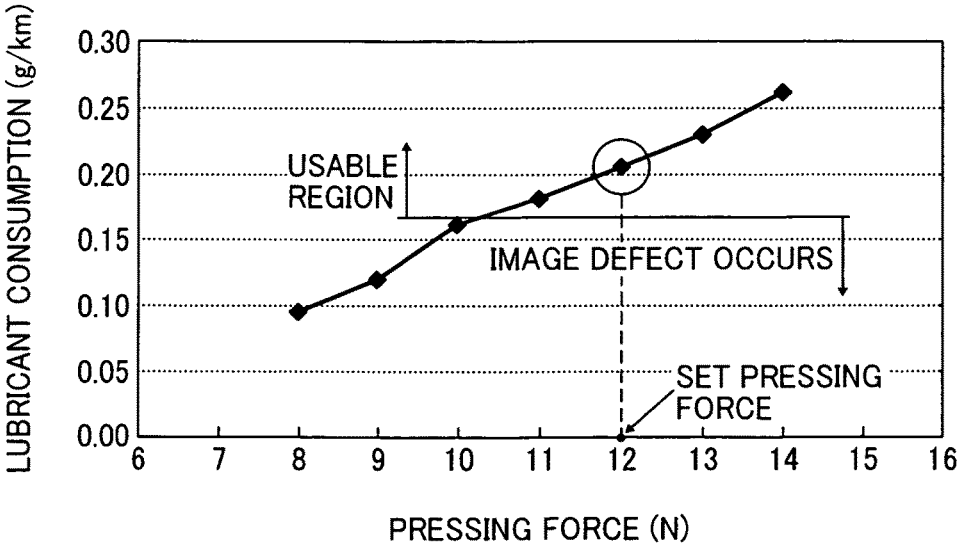
FIG. 5 is a graph showing a relation between the pressing force from the spring member in the lubricant applicator illustrated in FIG. 3 and the consumption (i.e., applied amount) of the solid lubricant illustrated in FIG. 3.

FIG. 5 is a graph showing a relation between the pressing force from the spring member in the lubricant applicator 129 and the consumption (i.e., applied amount) of the solid lubricant 74. FIG. 5 shows that the resulting image has defects when the lubricant consumption is 0.17 g/km or less. Therefore, the minimum pressing force is preferably equal to 0.17 g/km. Accordingly, the pressing force is set so that the lubricant consumption ranges above 0.17 g/km. More specifically, the pressing force is set to 12 N, at which the lubricant consumption is approximately 0.21 g/km.

Figure 6:
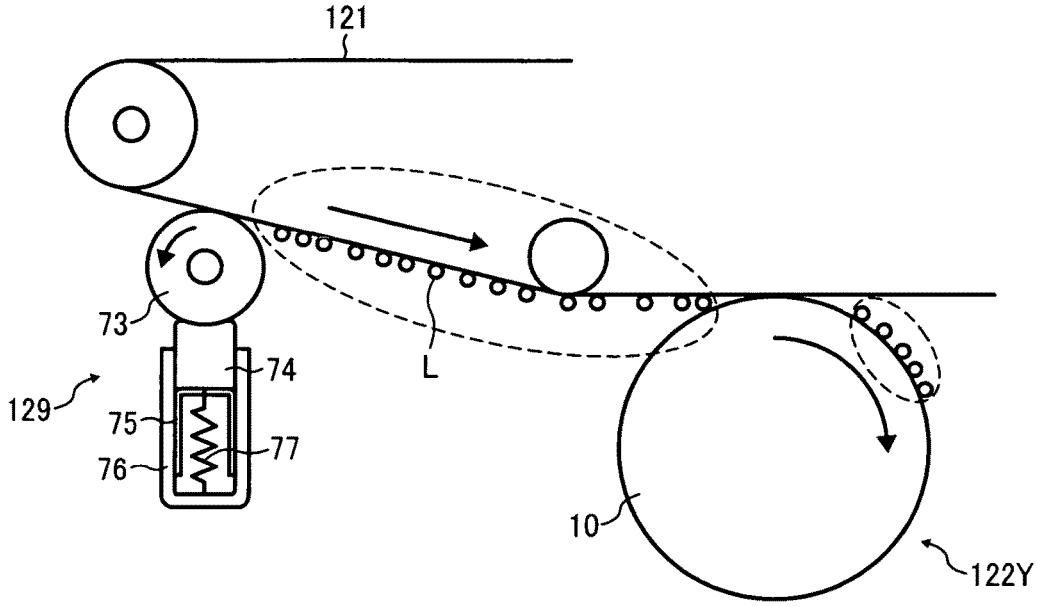
FIG. 6 schematically illustrates how the lubricant on the intermediate transfer belt illustrated in FIG. 1 is conveyed.

The lubricant powders on the intermediate transfer belt 121 pass by the four photoreceptors 10 on the way to the secondary transfer area 126. FIG. 6 schematically illustrates how the lubricant on the intermediate transfer belt 121 is conveyed. A lubricant powder L which is weakly adhering to the intermediate transfer belt 121 may be retransferred onto the photoreceptor 10 when passing by the photoreceptor 10. In particular, the lubricant powder L may be most considerably retransferred onto the extreme upstream photoreceptor 10 relative to the direction of rotation of the intermediate transfer belt 121, i.e., the photoreceptor 10 in the process cartridge 122Y in FIG. 1.

Figure 7:
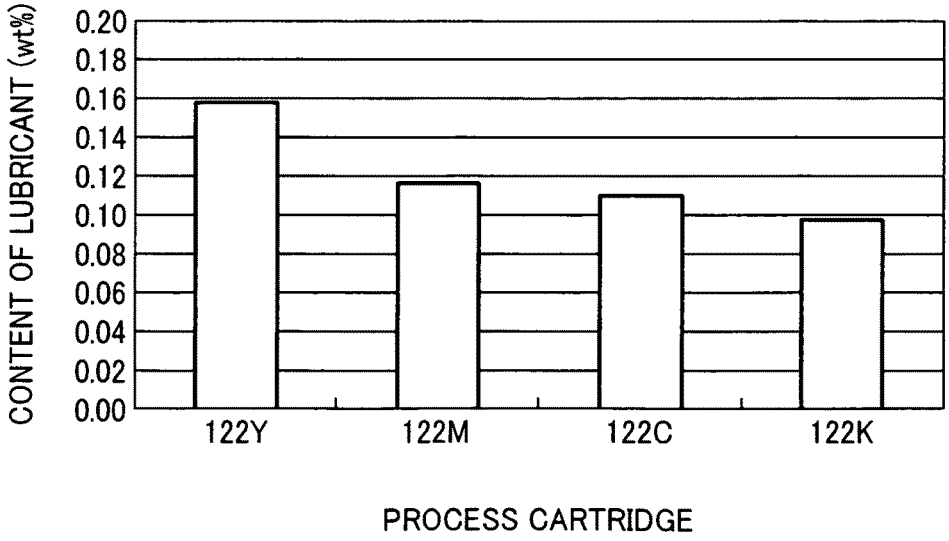
FIG. 7 is a graph showing the percentage content of the lubricant in waste toner particles collected from the four process cartridges illustrated in FIG. 1.

FIG. 7 is a graph showing the percentage content of the lubricant in waste toner particles collected from the process cartridges 122Y, 122M, 122C, and 122K. In each lubricant applicator 20 in each process cartridge 122, the pressing force of the spring member is set so that the lubricant consumption becomes 0.15 g/km. However, as is clear from FIG. 7, the percentage content of the lubricant in waste toner particles collected from 122Y is considerably greater than others. This reveals that a great amount of lubricant applied from the lubricant applicator 129 to the intermediate transfer belt 121 is retransferred onto the extreme upstream photoreceptor 10 in the extreme upstream process cartridge 122Y. It is estimated that the lubricant applied to the extreme upstream photoreceptor 10 in the extreme upstream process cartridge 122Y is 1.4 times greater than others.

To prevent such excessive application of lubricant to the extreme upstream photoreceptor 10 in the extreme upstream process cartridge 122Y, the pressing force of the spring member in the extreme upstream lubricant applicator 20 may be reduced, so that the amount of lubricant applied from the extreme upstream lubricant applicator 20 to the extreme upstream photoreceptor 10 is reduced. Thus, in the extreme upstream process cartridge 122Y, the amount of lubricant on the photoreceptor 10 is optimized by controlling the sum of that applied from the lubricant applicator 20 and that retransferred from the intermediate transfer belt 121.

As described above, the amount of lubricant applied to the photoreceptor 10 in the process cartridge 122Y is estimated 1.4 times greater than others, i.e., 0.15 g/km×1.4=0.21 g/km. Therefore, the amount of lubricant retransferred from the intermediate transfer belt 121 is estimated to be 0.21−0.15=0.06 g/km. Since the lubricant applicator 129 is adjusted so as to apply 0.2 g/km of lubricant to the intermediate transfer belt 121, the retransfer rate of lubricant from the intermediate transfer belt 121 onto the photoreceptor 10 in the process cartridge 122Y is calculated to be 0.06/0.2×100=30 (%).

Accordingly, in the process cartridge 122Y, the lubricant applicator 20 is preferably adjusted so as to apply 0.09 g/km of lubricant to the photoreceptor 10. Referring back to FIG. 4, the lubricant consumption is 0.09 g/km when the pressing force of the spring member is 8 N. Thus, by setting the pressing force of the spring member in the lubricant applicator 20 in the process cartridge 122Y to 8 N, while setting those in the other process cartridges to 11 N, the amount of lubricant on the photoreceptor 10 is virtually the same in all the process cartridges 122Y, 122M, 122C, and 122K.

In summary, the optimum amount of lubricant applied to the extreme upstream photoreceptor 10 can be calculated from the following formula:

$$X \leqq A + T \times (t/100) \leqq Y$$

wherein X and Y respectively represent the minimum and maximum amounts of lubricant applied to each of the photoreceptors 10 other than the extreme upstream photoreceptor 10, A represents the amount of lubricant applied from the extreme upstream lubricant applicator 20 to the extreme upstream photoreceptor 10, T represents the amount of lubricant applied from the lubricant applicator 129 to the intermediate transfer belt 121, and t represents the retransfer rate (%) of lubricant from the intermediate transfer belt 121 onto the extreme upstream photoreceptor 10. When A (i.e., the amount of lubricant applied from the extreme upstream lubricant applicator 20 to the extreme upstream photoreceptor 10) satisfies the above formula, high-density and high-quality images without defects are produced.

Figure 8:
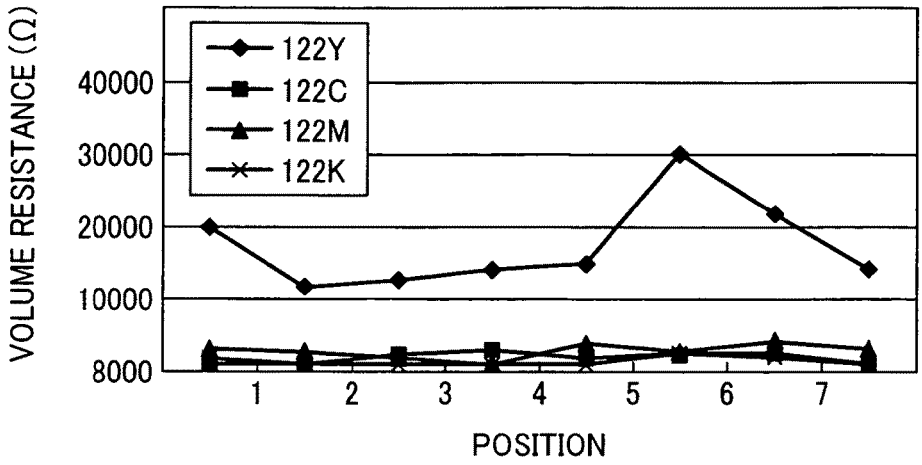
FIG. 8 is a comparative data showing a volume resistance distribution of the charging roller illustrated in FIG. 2 in the longitudinal direction after a running test, when setting the pressing force of the spring member in all the process cartridges illustrated in FIG. 1 to 11 N.
Figure 9:
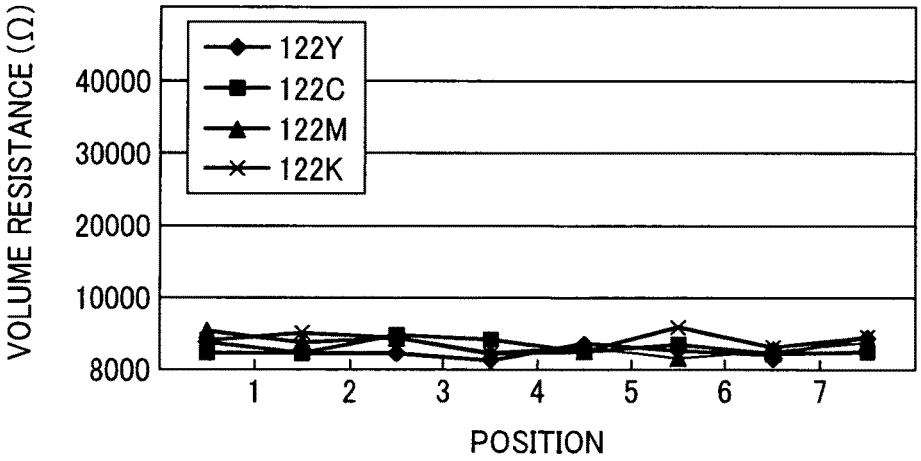
FIG. 9 is an exemplary data showing a volume resistance distribution of the charging roller illustrated in FIG. 2 in the longitudinal direction after the running test, when setting the pressing force of the spring member in the extreme upstream process cartridge illustrated in FIG. 1 to 8N while setting those in the other process cartridges illustrated in FIG. 1 to 11 N.

FIG. 8 is a comparative data showing a volume resistance distribution of the charging roller 41 in the longitudinal direction after a running test, when setting the pressing force of the spring member in all the process cartridges 122Y, 122M, 122C, and 122K to 11 N. FIG. 9 is an exemplary data showing a volume resistance distribution of the charging roller 41 in the longitudinal direction after the running test, when setting the pressing force of the spring member in the process cartridge 122Y to 8N while setting those in the other process cartridges 122M, 122C, and 122K to 11 N.

Figure 10:
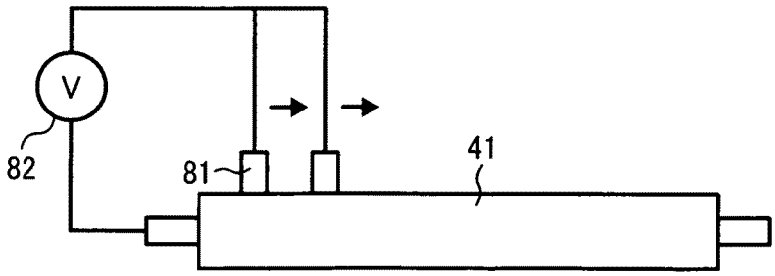
FIG. 10 is a schematic view illustrating a device for measuring the volume resistance of the charging roller illustrated in FIG. 2.

The volume resistance of the charging roller 41 is measured as follows. FIG. 10 is a schematic view illustrating a device for measuring the volume resistance of the charging roller 41. The charging roller 41 is rotatably disposed. Opposing electrodes 81 are rotatable in synchronization with rotation of the charging roller 41 and movable in the longitudinal direction. The metal core of the charging roller 41 is connected to a resistance measuring instrument 82, and the resistance measuring instrument 82 is further connected to the opposing electrodes 81. During measuring operation, the charging roller 41 is driven to rotate by a driving unit, not shown, and the opposing electrodes 81 also rotate along rotation of the charging roller 41. Upon application of a direct-current voltage of 100 V to the resistance measuring instrument 82, the resistance of the portion of the charging roller 41 where facing the opposing electrodes 81 is measured. The opposing electrodes 81 then move in the longitudinal direction to measure the resistance at eight portions of the charging roller 41. During the running test, an image having an image area occupancy of 5% is produced on 50,000 sheets of an A4-size recording material in each process cartridges 122.

As described above, FIG. 8 is a result when setting the pressing force of the spring member in all the process cartridges 122Y, 122M, 122C, and 122K to 11 N, and FIG. 9 is a result when setting the pressing force of the spring member in the process cartridge 122Y to 8N while setting those in the other process cartridges 122M, 122C, and 122K to 11 N. In FIG. 8, the volume resistance of the charging roller 41 in the process cartridge 122Y is extremely high. Additionally, the volume resistance distribution thereof is uneven, and therefore the resulting image is also uneven. By contrast, in FIG. 9, the volume resistance of the charging roller 41 in the process cartridge 122Y is similar to the others, and the volume resistance distribution thereof is uniform. The resulting image is high quality, and no filming occurs.

Preferably, the solid lubricant 21 applied to the photoreceptor 10 from the lubricant applicator 20 and the solid lubricant 74 applied to the intermediate transfer belt 121 from the lubricant applicator 120 are the same material. For example, solid hydrophobic lubricants, such as a solid zinc stearate, are preferable for the solid lubricants 21 and 74.

Specific preferred materials for the solid lubricants 21 and 74 further include, but are not limited to, metal salts of fatty acids, such as stearates (e.g., barium stearate, lead stearate, iron stearate, nickel stearate, cobalt stearate, copper stearate, strontium stearate, calcium stearate, cadmium stearate, magnesium stearate), oleates (e.g., zinc oleate, manganese oleate, iron oleate, cobalt oleate, lead oleate, magnesium oleate, copper oleate), palmitates (e.g., zinc palmitate, cobalt palmitate, copper palmitate, magnesium palmitate, aluminum palmitate, calcium palmitate), lead caprylate, lead caproate, zinc linolenate, cobalt linolenate, calcium linolenate, and cadmium linolenate; and waxes (e.g., candelilla wax, carnauba wax, rice wax, haze wax, jojoba oil, bees wax, lanoline).

Preferred embodiments of the toner for use in the above-described image forming apparatus are described below.

The toner preferably has a weight average particle diameter (D4) of from 3 to 8 μm. Such a toner can reliably reproduce micro dots having a resolution of 600 dpi or more. When D4 is too small, the toner may have poor transfer efficiency and may be difficult to remove by a blade. When D4 is too large, toner particles may scatter in text and line images.

The ratio (D4/D1) of the weight average particle diameter (D4) to the number average particle diameter (D1) is preferably between 1.00 and 1.40. As D4/D1 approaches 1.00, the particle diameter distribution becomes much narrower. Such a toner having a small particle diameter and a narrow particle diameter distribution can be charged uniformly, and produces high-quality images without fogging. Further, such a toner has excellent transfer efficiency.

The particle diameter distribution of a toner can be measured by a measuring instrument such as COULLTER COUNTER TA-II or COULTER MULTISIZER II (both from Beckman Coulter, Inc.).

A measuring procedure is as follows. First, 0.1 to 5 ml of a surfactant (preferably an alkylbenzene sulfonate) is included as a dispersant in 100 to 150 ml of an electrolyte (i.e., a 1% NaCl aqueous solution including a first grade sodium chloride, such as ISOTON-II from Coulter Electrons Inc.) Thereafter, 2 to 20 mg of a toner is added to the electrolyte and dispersed using an ultrasonic dispersing machine for about 1 to 3 minutes to prepare a toner suspension liquid. The weight and number of toner particles in the toner suspension liquid are measured by the above instrument equipped with an aperture of 100 μm. The weight average particle diameter (D4) and the number average particle diameter (Dn) are determined from the measured volume distribution and number distribution, respectively.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Accordingly, particles having a particle diameter of from not less than 2.00 μm to less than 40.30 μm can be measured.

Figure 11A:
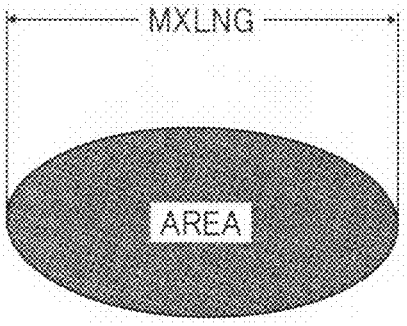
FIGS. 11A and 11B are schematic views for explaining the shape factors SF-1 and SF-2, respectively.
Figure 11B:
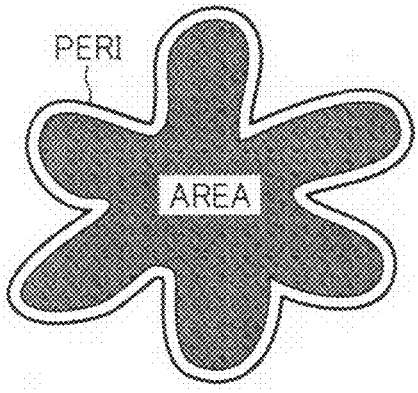

The toner preferably has a shape factor SF-1 of from 100 to 180, and a shape factor SF-2 of from 100 to 180. FIGS. 11A and 11B are schematic views for explaining the shape factors SF-1 and SF-2, respectively.

As illustrated in FIG. 11A, the shape factor SF-1 represents the degree of roundness of a toner particle, and is defined by the following equation (1):

$$\text{SF-1}=\{(\text{MXLNG})^2/(\text{AREA})\}\times(100\pi/4) \quad (1)$$

wherein MXLNG represents the maximum diameter of a projected image of a toner particle to a two-dimensional plane; and AREA represents the area of the projected image.

When the SF-1 is 100, the toner particle has a true spherical shape. The larger SF-1 a toner particle has, the more irregular shape the toner particle has.

As illustrated in FIG. 11B, the shape factor SF-2 represents the degree of concavity and convexity of a toner particle, and is defined by the following equation (2):

$$\text{SF-2}=\{(\text{PERI})^2/(\text{AREA})\}\times(100/4\pi) \quad (2)$$

wherein PERI represents the peripheral length of a projected image of a toner particle to a two-dimensional plane; and AREA represents the area of the projected image.

When the SF-2 is 100, the toner particle has no concavity and convexity, i.e., a smooth surface. The larger SF-2 a toner particle has, the rougher surface the toner particle has.

The shape factors SF-1 and SF-2 are determined by photographing toner particles using a scanning electron microscope (S-800 manufactured by Hitachi Ltd.), and then analyzing the photographic image of the toner particles using an image analyzer (LUZEX 3 manufactured by Nireco Corp.).

As the shape of a toner particle approaches a sphere, the toner particle is likely to point-contact another toner particle or a photoreceptor. Thus, the adsorptive force between the toner particles is reduced, increasing fluidity of the toner particles. Also, the adsorptive force between the toner particle and the photoreceptor is reduced, increasing transfer efficiency of the toner particles. When either of SF-1 or SF-2 is above 180, transfer efficiency may deteriorate, which is not preferable.

Preferably, fine particles having an average primary particle diameter of from 50 to 500 nm and a bulk density of 0.3 g/cm$^3$ or more are adhered to the surfaces of the toner particles. Such toner particles are easy to remove from the photoreceptor, and do not reduce their developability and transferability even when the particle diameter is small.

Specific preferred materials for such fine particles include silica. A typical Silica has an average primary particle diameter of from 50 to 500 nm and a bulk density of from 0.1 to 0.2 g/cm$^3$.

When such fine particles are present on the surface of the toner particle, an appropriate gap is formed between the toner particle and another member, such as a photoreceptor, a charging member, and another toner particle. Since the fine particles evenly contact another member with a very small contact area, the adhesive force therebetween is reduced, resulting in improvement of developability and transfer efficiency of the toner particle.

Further, the fine particles present on the surface of the toner particles also function as a roller member which prevents the photoreceptor from being abraded or damaged by a cleaning blade. Moreover, the fine particle may not buried in the toner particles even when receiving high-load and high-speed stress from the cleaning blade. Even when buried in the toner particles, the fine particles can easily release therefrom and accumulate on the leading edge of the cleaning blade. Such fine particles accumulated on the leading edge of the cleaning blade advantageously prevent toner particles from passing through the cleaning blade.

The fine particles also reduce shear applied to toner particles. Thus, even when the toner particles include a low-rheology component (preferable for high-speed and low-energy fixing), the occurrence of filming is prevented. The fine particles having an average primary particle diameter of from 50 to 500 nm can give excellent cleanability to the toner particle without decreasing fluidity because of their extremely small particle diameter.

The surface-treated fine particles are also preferable, because they are likely not to degrade a developer even when contaminating carrier particles in the developer.

As described above, the fine particles have an average primary particle diameter of from 50 to 500 nm, and more preferably from 100 to 400 nm. When the average primary particle diameter is too small, the fine particles may get into concavities on the surface of the toner particle, and may not function as a roller member. When the average primary particle diameter is too large, the fine particle may contact the cleaning blade or the photoreceptor with a contact area similar to that of the toner particle, allowing the toner particles to pass through the cleaning blade.

As described above, the fine particles have a bulk density of 0.3 g/cm$^3$ or more. When the bulk density it too small, the fine particles may easily scatter and have high adhesive force. Such fine particles may not function as a roller member or accumulate on the cleaning blade.

Specific preferred inorganic materials for the fine particles include, but are not limited to, $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)_n$, $Al_2O_3.2SiO_2$, $CaCO_3$, $MgCO_3$, $BaSO_4$, $MgSO_4$, and $SrTiO_3$. Among these materials, $SiO_2$, $TiO_2$, $Al_2O_3$ are preferable.

These inorganic compounds may be hydrophobized with a coupling agent such as hexamethyldisilazane, dimethyldichlorosilane, and octyl trimethoxysilane.

Specific preferred organic materials for the fine particles include, but are not limited to, thermoplastic and thermosetting resins such as vinyl resin, polyurethane resin, epoxy resin, polyester resin, polyamide resin, polyimide resin, silicone-containing resin, phenol resin, melamine resin, urea resin, aniline resin, ionomer resin, and polycarbonate resin. These organic materials can be used alone or in combination. Among these materials, vinyl resin, polyurethane resin, epoxy resin, and polyester resin are preferable because aqueous dispersions of their fine particles are easily obtainable. Specific examples of the vinyl resin include, but are not limited to, homopolymers and copolymers of vinyl monomers, such as styrene-(meth)acrylate copolymer, styrene-butadiene copolymer, (meth)acrylic acid-acrylate copolymer, styrene-acrylonitrile copolymer, styrene-maleic anhydride copolymer, and styrene-(meth)acrylic acid copolymer.

The bulk density (D) can be measured as follows. First, a 100-mL graduated cylinder is charged with the fine particles without vibration. Thereafter, the difference in weight (W) of the cylinder before and after charged with the fine particles is measured. The bulk density is calculated from the following equation:

$$D(\text{g/cm}^3)=W(\text{g/100 mL})/100$$

The fine particles are adhered to the surfaces of the toner particles by, for example, mechanically mixing the toner particles with the fine particles using a mixer, or dispersing the toner particles and the fine particles in a liquid containing a surfactant, followed by drying.

The toner having a glass transition temperature (Tg) of from 45 to 65° C. and a flow starting temperature of from 90 to 115° C. expresses good fixability when used in the image forming apparatus according to this specification. When Tg and/or flow starting temperature are/is too low, offset may occur when the toner is fixed on a recording material. When Tg and/or flow starting temperature are/is too high, the toner may not reliably fixed on a recording material and easily release therefrom.

Tg can be measured using a measuring instrument TG-DSC system TAS-100 (from Rigaku Corporation) as follows. About 10 mg of a sample are contained in an aluminum container, and the container is put on a holder unit and set in an electric furnace. The sample is heated from room temperature to 150° C. at a heating rate of 10° C./min, kept at 150° C. for 10 minutes, cooled to room temperature, and kept at room temperature for 10 minutes. Thereafter, the sample is reheated to 150° C. at a heating rate of 10° C./min in nitrogen atmosphere to obtain an endothermic curve. Tg is determined from an intersection of a contact line of the endothermic curve and the base line, using an analysis system in TAS-100.

Figure 12:
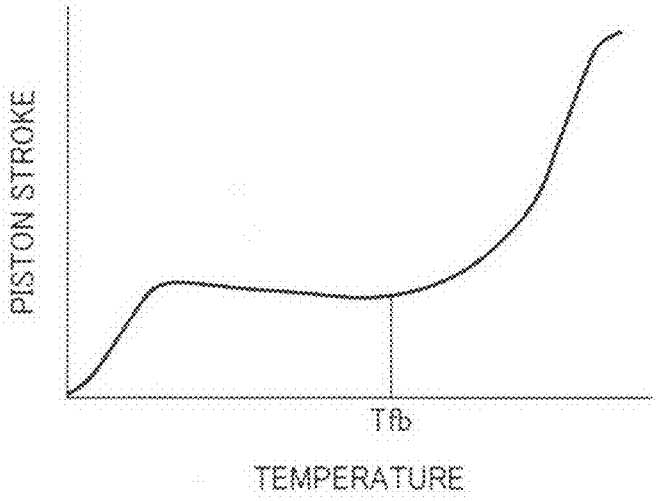
FIG. 12 shows a flow curve of a toner obtained by the flow tester.

The flow starting temperature is measured using a flow tester such as CAPILLARY RHEOMETER CFT-500D (from Shimadzu Corporation). FIG. 12 shows a flow curve obtained by the flow tester. Tfb represents the flow starting temperature. The measuring conditions are as follows: the load is 5 kg/cm$^2$, the heating rate is 3.0° C./min, the die diameter is 1.00 mm, and the die length is 10.0 mm.

The toner includes a binder resin. Specific preferred examples of suitable materials for the binder resin include, but are not limited to, polyesters, homopolymers of styrene or styrene derivatives (e.g., polystyrene, poly p-chlorostyrene, polyvinyl toluene), and copolymers of styrenes (e.g., styrene-p-chlorostyrene copolymer, styrene-propylene copolymer, styrene-vinyl toluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer). Among these materials, polyesters are preferable from the viewpoint of fixability.

The following materials can be used in combination with the above materials: polymethyl methacrylate, polybutyl methacrylate, polyvinyl chloride, polyvinyl acetate, polyethylene, polypropylene, polyurethane, polyamide, epoxy resins, polyvinyl butyral, polyacrylic acid resin, rosin, modified rosin, terpene resin, phenol resin, aliphatic or alicyclic hydrocarbon resin, aromatic petroleum resin, chlorinated paraffin, and paraffin wax.

A polyester resin is formed from a condensation polymerization between an alcohol and a carboxylic acid.

Specific examples of usable alcohols include, but are not limited to, diols (e.g., polyethylene glycol, diethylene glycol, triethylene glycol, 1,2-propylene glycol, 1,3-propylene glycol, 1,4-butanediol, neopentyl glycol, 1,4-butenediol), etherified bisphenols (e.g., 1,4-bis(hydroxymethyl)cyclohexane, bisphenol A, hydrogenated bisphenol A, polyoxyethylene adduct bisphenol A, polyoxypropylene adduct bisphenol A), divalent alcohols in which the above alcohols are substituted with a saturated or unsaturated hydrocarbon group having 3 to 22 carbon atoms, and any other divalent alcohols.

Specific examples of usable carboxylic acids include, but are not limited to, maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, divalent organic acids in which the above carboxylic acids are substituted with a saturated or unsaturated hydrocarbon group having 3 to 22 carbon atoms, anhydrides of the divalent organic acids, dimers of lower alkyl esters and linolenic acid, and any other divalent organic acids.

The polyester resin can be formed from not only the above-described difunctional monomers but also trifunctional or polyfunctional monomers.

Specific examples of usable trifunctional or polyfunctional alcohols include, but are not limited to, sorbitol, 1,2,3,6-hexaneteraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of usable trifunctional or polyfunctional carboxylic acids include, but are not limited to, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and anhydrides of these acids.

The toner may include a release agent to improve releasability from a fixing member when fixed on a recording material.

Specific preferred materials for the release agent include, but are not limited to, free-fatty-acid-free carnauba wax, montan wax, oxidized rice wax, and ester wax. These materials can be used alone or in combination. A suitable carnauba wax is in a form of microcrystal and has an acid value of 5 or less, and is dispersed in the toner with a dispersion diameter of 1 μm or less. A suitable montan wax is purified from a mineral and in a form of microcrystal, and has an acid value of from 5 to 14. A suitable oxidized rice wax is obtained by oxidizing a rice bran wax, and has an acid value of from 10 to 30.

When the acid value of such waxes is too small, the minimum fixable temperature of the toner may increase, thereby suppressing low-temperature fixing. By contrast, when the acid value of such waxes is too large, the temperature below which cold offset occurs may increase, thereby also suppressing low-temperature fixing.

The content of the release agent in the toner is preferably from 1 to 15 parts by weight, more preferably from 3 to 10 parts by weight, based on 100 parts by weight of the binder resin. When the content of release agent is too small, the toner may have poor releasability. When the content of release agent is too large, the release agent may disadvantageously adhere to carrier particles in a developer.

The toner may include a charge controlling agent to improve chargeability. Specific preferred materials for the chare controlling agent include, but are not limited to, positive charge controlling agents such as nigrosine, basic dyes, lake pigments of basic dyes, and quaternary ammonium salt compounds; and negative charge controlling agents such as metal salts of monoazo dyes, and metal complexes of salicylic acid, naphthoic acid, and dicarboxylic acid.

The content of the charge controlling agent in the toner is preferably from 0.01 to 8 parts by weight, more preferably from 0.1 to 2 parts by weight, based on 100 parts by weight of the binder resin. When the content of charge controlling agent is too small, the toner charge may be affected by environmental variation. When the content of charge controlling agent is too large, the toner may not be fixable at relatively low temperatures.

The toner may further include a metal-containing monoazo dye so that the toner may be more quickly charged to a saturated charge level. Specific examples of usable metal-containing monoazo dyes include, but are not limited to, chromium-containing monoazo dyes, cobalt-containing monoazo dyes, and iron-containing monoazo dyes. These monoazo dyes can be used alone or in combination.

The content of such dyes in the toner is preferably from 0.1 to 10 parts by weight, more preferably from 1 to 7 parts by weight, based on 100 parts by weight of the binder resin. When the content of dyes is too small, the toner may not be quickly charged. When the content of dyes is too large, the saturated charge level may disadvantageously decrease.

In a case where the toner is used in full-color image forming apparatuses, the charge controlling material is preferably selected from transparent or whitish materials, such as metal salts of salicylic acid derivatives, so as not to change the color tone of the toner. Other than metal salts of salicylic acid derivatives, boron salts of organic materials, fluorine-containing quaternary ammonium salts, and calixarene compounds are also preferable.

The toner may include a magnetic material to be used as a magnetic toner. Specific examples of usable magnetic materials include, but are not limited to, iron oxides (e.g., magnetite, hematite, ferrite), metals (e.g., iron, cobalt, nickel) and alloys or mixtures thereof with metals such as aluminum, cobalt, copper, lead, magnesium, tin, zinc, antimony, beryllium, bismuth, cadmium, calcium, manganese, selenium, titanium, tungsten, and vanadium. The magnetic material preferably has an average diameter of from 0.1 to 2 μm. The content of the magnetic material in the toner is preferably from about 20 to 200 parts by weight, more preferably from 40 to 150 parts by weight, based on 100 parts by weight of the binder resin.

The toner includes a colorant. Specific examples of usable black colorants include, but are not limited to, carbon black, aniline black, furnace black, and lamp black. Specific examples of usable cyan colorants include, but are not limited to, phthalocyanine blue, methylene blue, Victoria blue, methyl violet, aniline blue, and ultramarine blue. Specific examples of usable magenta colorants include, but are not limited to, rhodamine 6G lake, dimethylquinacridone, watching red, rose bengal, rhodamine B, and alizarine lake. Specific examples of usable yellow colorants include, but are not limited to, chrome yellow, benzidine yellow, hansa yellow, naphthol yellow, molybdenum orange, quinoline yellow, and tartrazine.

In addition, the following dyes and pigments are also usable: phthalocyanine green, hansa yellow G, calco oil blue, quinacridone, and triarylmethane dyes.

To improve fluidity of the toner, hydrophobized silica, titanium oxide, and/or alumina, optionally together with metal salts of fatty acids or polyvinylidene fluoride, may be externally adhered to the surface of the toner.

The toner may be used for a two-component developer comprising the toner and a carrier. The carrier comprises core particles and an optional coating layer formed thereon. Specific preferred materials for the core particles include, but are not limited to, ferromagnetic metal powders (e.g., iron, nickel, cobalt), metal oxide powders (e.g., magnetite, hematite, ferrite), and glass beads. Such core particles preferably have an average particle diameter of from 10 to 1,000 μm, more preferably from 30 to 500 μm.

Specific preferred resins used for the coating layer include, but are not limited to, styrene-acrylic copolymer, silicone resin, maleic acid resin, fluorine-containing resin, polyester resin, and epoxy resin. A suitable styrene-acrylic copolymer preferably includes 30 to 90% by weight of styrene units. When the amount of styrene unit is too small, the toner may have poor developability. When the amount of styrene unit is too large, the coating layer may be too rigid and easily peel off, resulting in short lifespan of the carrier.

The resin used for the coating layer may further include an adhesive agent, a hardening agent, a lubricant, a conductive agent, a charge controlling agent, etc. The weight of the resin (i.e., the coating layer) is preferably from 1 to 10% by weight of the core particles.

Specific examples of commercially available silicone resins include, but are not limited to, KR261, KR271, KR272, KR275, KR280, KR282, KR285, KR251, KR155, KR220, KR201, KR204, KR205, KR206, SA-4, ES1001, ES1001N, ES1002T, and KR3093 (all from Shin-Etsu Chemical Co., Ltd.); and SR2100, SR2101, SR2107, SR2110, SR2108, SR2109, SR2115, SR2400, SR2410, SR2411, SH805, SH806A, and SH840 (all from Dow Corning Toray Co., Ltd.). A silicone resin coating layer can be formed on the core particles by spray coating or dipping, for example.

The toner may be prepared by, for example, subjecting a toner components liquid dispersing or dissolving a polyester prepolymer having a nitrogen-containing functional group, a polyester, a colorant, and a release agent in an organic solvent to cross-linking and/or elongating reactions in an aqueous medium.

The polyester included in the toner components liquid is prepared from a polycondensation reaction between a polyol and a polycarboxylic acid.

The polyol (PO) may be a diol (DIO) or a polyol (TO) having 3 or more valences. A diol (DIO) alone or a mixture of a diol (DIO) with a small amount of a polyol (TO) is preferable.

Specific examples of the diol (DIO) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the above alicyclic diols, and alkylene oxide (e.g., ethylene oxide, propylene oxide, butylene oxide) adducts of the above bisphenols.

Among these diols, alkylene glycols having 2 to 12 carbon atoms and alkylene oxide adduct of bisphenols are preferable, and a mixture of an alkylene glycol having 2 to 12 carbon atoms and an alkylene oxide adduct of a bisphenol is more preferable.

Specific examples of the polyols (TO) having 3 or more valences include, but are not limited to, polyvalent aliphatic alcohols having 3 or more valences (e.g., glycerin, trimethylolethane, trimethylolpropane, pentaerythritol, sorbitol), phenols having 3 or more valences (e.g., tris phenol PA, phenol novolac, cresol novolac), and alkylene oxide adducts of the above phenols having 3 or more valences.

The polycarboxylic acid (PC) may be a dicarboxylic acid (DIC) or a polycarboxylic acid (TC) having 3 or more valences. A dicarboxylic acid (DIC) alone or a mixture of a dicarboxylic acid (DIC) with a small amount of a polycarboxylic acid (TC) is preferable.

Specific examples of the dicarboxylic acid (DIC) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acid (e.g., phthalic acid, isophthalic acid, terephthalic acid, naphthalenedicarboxylic acid).

Among these dicarboxylic acids, alkenylene dicarboxylic acids having 4 to 20 carbon atoms and aromatic dicarboxylic acids having 8 to 20 carbon atoms are preferable.

Specific examples of the polycarboxylic acid (TC) having 3 or more valences include, but are not limited to, aromatic polycarboxylic acids having 9 to 20 carbon atoms (e.g., trimellitic acid, pyromellitic acid), and anhydrides and lower alkyl esters (e.g., methyl ester, ethyl ester, isopropyl ester) thereof.

The equivalent ratio ([OH]/[COOH]) of hydroxyl groups [OH] in the polyol (PO) to carboxyl groups [COOH] in the polycarboxylic acid (PC) is 2/1 to 1/1, preferably from 1.5/1 to 1/1, and more preferably from 1.3/1 to 1.02/1.

A polycondensation reaction between the polyol (PO) and the polycarboxylic acid (PC) is undergone at a temperature of from 150 to 280° C. in the presence of an esterification catalyst (e.g., tetrabutoxy titanate, dibutyltin oxide), while optionally reducing pressure and removing produced water. Thus, a polyester having hydroxyl groups is obtained. This polyester may be hereinafter referred to as the unmodified polyester for the sake of clarity. The unmodified polyester preferably has a hydroxyl value of 5 or more; and an acid value of from 1 to 30, more preferably from 5 to 20. The unmodified polyester having such an acid value is easily chargeable to negative polarity, and expresses affinity for recording paper when fixed thereon. When the acid value is too large, the toner may be affected by environmental variations. The unmodified polyester preferably has a weight average molecular weight of from 10,000 to 400,000, more preferably from 20,000 to 200,000. When the weight average molecular weight is too small, the toner may have poor offset resistance. When the weight average molecular weight is too large, the toner may not be fixed at relatively low temperatures.

The polyester prepolymer having a nitrogen-containing functional group included in the toner components liquid may be a polyester prepolymer (A) having an isocyanate group. The polyester prepolymer (A) having an isocyanate group is prepared by reacting terminal carboxyl or hydroxyl groups of the above-prepared unmodified polyester with a polyisocyanate compound (PIC). The polyester prepolymer (A) having an isocyanate group is subjected to cross-linking and/or elongating reactions with an amine (B) to form an urea-modified polyester.

Specific examples of the polyisocyanate compound (PIC) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanate (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, the above polyisocyanates blocked with phenol derivatives, oxime, or caprolactam. These compounds can be used alone or in combination.

The equivalent ratio ([NCO]/[OH]) of isocyanate groups [NCO] in the polyisocyanate compound (PIC) to hydroxyl groups [OH] in the unmodified polyester is preferably from 5/1 to 1/1, more preferably from 4/1 to 1.2/1, and most preferably from 2.5/1 to 1.5/1. When [NCO]/[OH] is too large, the toner may not be fixed at relatively low temperatures. When [NCO]/[OH] is too small, the toner may have poor offset resistance.

The polyester prepolymer (A) preferably includes the polyisocyanate compound (PIC) units in an amount of from 0.5 to 40% by weight, preferably from 1 to 30% by weight, and more preferably from 2 to 20% by weight. When the amount of the polyisocyanate compound (PIC) units is too small, the toner may have poor offset resistance, heat-resistant storage stability, and low-temperature fixability. When the amount of the polyisocyanate compound (PIC) units is too large, the toner may have poor low-temperature fixability. The number of isocyanate groups included in one molecule of the polyester prepolymer (A) is preferably 1 or more, more preferably from 1.5 to 3, and most preferably from 1.8 to 2.5. When the number of isocyanate groups per molecule is too small, the resulting urea-modified polyester may have too small a molecular weight, and therefore the resulting toner may have poor hot offset resistance.

The amine (B) to be reacted with the polyester prepolymer (A) may be a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmetahne); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Among these amines (B), a diamine (B1) alone and a mixture of a diamine (B1) with a small amount of a polyamine (B2) having 3 or more valences are preferable.

The equivalent ratio ([NCO]/[NHx]) of isocyanate groups [NCO] in the polyester prepolymer (A) to amino groups [NHx] in the amine (B) is preferably from 1/2 to 2/1, more preferably from 1.5/1 to 1/1.5, and most preferably from 1.2/1 to 1/1.2. When [NCO]/[NHx] is too large or small, the resulting urea-modified polyester may have too small a molecular weight, and therefore the resulting toner may have poor hot offset resistance.

The urea-modified polyester may include urethane bonds other than urea bonds. In such a case, the molar ratio of urea bonds to urethane bonds is preferably from 100/0 to 10/90, more preferably from 80/20 to 20/80, and most preferably from 60/40 to 30/70. When the molar ratio of urea bonds is too small, hot offset resistance of the toner may decrease. Such a urea-modified polyester may be prepared by reacting a polyol (PO) with a polycarboxylic acid (PC) at a temperature of from 150 to 280° C. in the presence of an esterification catalyst (e.g., tetrabutoxy titanate, dibutyltin oxide), while optionally reducing pressure and removing produced water; reacting the resulting unmodified polyester having hydroxyl groups with a polyisocyanate (PIC) at a temperature of from 40 to 140° C.; and further reacting the resulting polyester prepolymer (A) with an amine (B) at a temperature of from 0 to 140° C.

When reacting the unmodified polyester with the polyisocyanate (PIC), or reacting the polyester prepolymer (A) with the amine (B), solvents can be used, if needed. Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against the polyisocyanate (PIC).

To control the molecular weight of the urea-modified polyester resulting from the cross-linking and/or elongating reactions between the polyester prepolymer (A) and the amine (B), a reaction terminator can be used.

Specific preferred materials for the reaction terminator include, but are not limited to, monoamines (e.g., diethylamine, dibutylamine, butylamine, laurylamine) and blocked materials of these monoamines (e.g., ketimine compounds).

The urea-modified polyester preferably has a weight average molecular weight of 10,000 or more, more preferably from 20,000 to 10,000,000, and most preferably from 30,000 to 1,000,000. When the weight average molecular weight is too small, hot offset resistance of the toner may be poor.

As is clear from the above descriptions, the resulting toner includes the unmodified polyester and the urea-modified polyester. The combination of the unmodified polyester and the urea-modified polyester improves the resulting image gloss compared to a case where the urea-modified polyester is used alone. The unmodified polyester may have any chemical bonds other than urea bonds. It is preferable that the unmodified polyester and the urea-modified polyester are partially or completely compatible with each other from the viewpoint of low-temperature fixability and hot offset resistance of the toner. Therefore, the unmodified polyester and the urea-modified polyester preferably have a similar chemical composition. The weight ratio of the unmodified polyester to the urea-modified polyester is preferably from 20/80 to 95/5, more preferably 70/30 to 95/5, much more preferably from 75/25 to 95/5, and most preferably from 80/20 to 93/7. When the amount of the urea-modified polyester is too small, hot offset resistance, heat-resistant storage stability, and low-temperature fixability of the toner may be poor. The binder resin comprising the unmodified polyester and the urea-modified polyester preferably has a glass transition (Tg) of from 45 to 65° C., more preferably from 45 to 60° C. When Tg is too small, heat-resistant stability of the toner may be poor. When Tg is too large, low-temperature fixability of the toner may be poor. Because the above-prepared toner includes the urea-modified polyester mainly on its surface, heat-resistance storage stability is good even when Tg is relatively small.

As describe above, the toner components liquid includes the colorant. Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The content of the colorant in the toner is preferably from 1 to 15% by weight, and more preferably from 3 to 10% by weight.

The colorant can be combined with a resin to be used as a master batch. Specific examples of the resin for use in the master batch include, but are not limited to, styrene or styrene derivatives polymers (e.g., polystyrene, poly-p-chlorostyrene, polyvinyl toluene), copolymers of the above styrene polymers and vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. These resins can be used alone or in combination.

The toner components liquid may optionally include a charge controlling agent. Specific examples of usable charge controlling agent include, but are not limited to, Nigrosine dyes, triphenylmethane dyes, metal complex dyes including chromium, chelate pigments of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and metal salts of salicylic acid derivatives.

Specific examples of commercially available charge controlling agents include, but are not limited to, BONTRON° N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, and a quaternary ammonium group. Charge controlling agents which can charge the toner to a negative polarity are preferable.

The content of the charge controlling agent is preferably 0.1 to 10 parts by weight, more preferably from 0.2 to 5 parts by weight, based on 100 parts by weight of the binder resin. When the content of charge controlling agent is too large, the toner may be excessively charged and electrostatically attracted to a developing roller, resulting in poor fluidity of the toner and low image density.

The release agent in the toner components liquid may be a wax having a low melting point of from 50 to 120° C. Such a wax effectively functions at an interface between the toner and a fixing member, thus preventing hot offset of the toner.

Specific examples of such waxes include, but are not limited to, natural waxes such as plant waxes (e.g., carnauba wax, cotton wax, sumac wax, rice wax), animal waxes (e.g., bees wax, lanoline), mineral waxes (e.g., ozokerite, ceresin), and petroleum waxes (e.g., paraffin, microcrystalline, petrolatum); synthetic hydrocarbon waxes (e.g., Fischer-Tropsch wax, polyethylene wax); and synthetic waxes of esters, ketones, and ethers. Additionally, crystalline polymers having a long side alkyl chain, such as fatty acid amides (e.g., 12-hydroxystearic acid amide, stearic acid amide, phthalic anhydride imide, chlorinated hydrocarbon) and homopolymers and copolymers of polyacrylates (e.g., poly-n-stearyl methacrylate, poly-n-lauryl methacrylate, n-stearyl acrylate-ethyl methacrylate copolymer), are also preferable for the release agent.

The charge controlling agent and the release agent may be melt-kneaded with the above-described colorant master batch before added to the toner components liquid.

One specific example of the above-described method of manufacturing toner is described below.

First, a toner components liquid is prepared by dispersing or dissolving a colorant, an unmodified polyester, a polyester prepolymer having an isocyanate group, and a release agent in an organic solvent. Preferably, the organic solvent is a volatile solvent having a boiling point of less than 100° C. because such a solvent is easy to remove from the resulting toner particles. Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, aromatic solvents (e.g., toluene, xylene) and halogenated hydrocarbons (e.g., methylene chloride, 1,2-dichloroethane, chloroform, carbon tetrachloride) are preferable. The used amount of the organic solvent is preferably from 0 to 300 parts by weight, more preferably from 0 to 100 parts by weight, and most preferably from 25 to 70 parts by weight, based on 100 parts by weight of the polyester prepolymer.

Second, the above-prepared toner components liquid is emulsified in an aqueous medium in the presence of a surfactant and a particulate resin. The aqueous medium may be water alone or a mixture of water with an organic solvent such as an alcohol (e.g., methanol, isopropyl alcohol, ethylene glycol), dimethylformamide, tetrahydrofuran, a cellosolve (e.g., methyl cellosolve), and a lower ketone (e.g., acetone, methyl ethyl ketone), for example. The used amount of the aqueous medium is preferably from 50 to 2,000 parts by weight, more preferably from 100 to 1,000 parts by weight, based on 100 parts by weight of the toner components liquid. When the used amount of the aqueous medium is too small, the toner components liquid cannot be finely dispersed in the aqueous medium, and desired-size particles cannot be obtained. When the used amount of the aqueous medium is too large, it may result in a cost increase.

The surfactant and the particulate resin are added to the aqueous medium as dispersers for reliably dispersing the toner components liquid therein. Specific examples of usable surfactants include, but are not limited to, anionic surfactants (e.g., alkylbenzene sulfonate, α-olefin sulfonate, phosphate), amine salt type cationic surfactants (e.g., alkylamine salts, amino alcohol fatty acid derivatives, imidazoline), quaternary ammonium salt type cationic surfactants (e.g., alkyl trimethyl ammonium salt, dialkyl dimethyl ammonium salt, alkyl dimethyl benzyl ammonium salt, pyridinium salt, alkyl isoquinolinium salt, benzethonium chloride), nonionic surfactants (e.g., fatty acid amide derivatives, polyol derivatives), and ampholytic surfactants (e.g., alanine, dodecyl di(aminoethyl) glycine, di(octyl aminoethyl) glycine, N-alkyl-N,N-dimethyl ammonium betaine).

Surfactants having a fluoroalkyl group are also usable. Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl (C6-C16) ethyl phosphates.

Specific examples of commercially available such anionic surfactants having a fluoroalkyl group include, but are not limited to, SURFLON® S-111, S-112, and S-113 (from AGC Seimi Chemical Co., Ltd.); FLUORAD™ FC-93, FC-95, FC-98, and FC-129 (from Sumitomo 3M); UNIDYNE™ DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of cationic surfactants having a fluoroalkyl group include, but are not limited to, aliphatic primary, secondary, and tertiary amine acids having a fluoroalkyl group; and aliphatic tertiary ammonium salts such as perfluoroalkyl(C6-C10) sulfonamide propyl trimethyl ammonium salts, benzalkonium salts, benzethonium chlorides, pyridinium salts, and imidazolinium salts.

Specific examples of commercially available such cationic surfactants having a fluoroalkyl group include, but are not limited to, SURFLON® S-121 (from AGC Seimi Chemical Co., Ltd.); FLUORAD™ FC-9135 (from Sumitomo 3M); UNIDYNE™ DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

The particulate resin stabilizes formation of mother toner particles in the aqueous medium by covering 10 to 90% by area of the surfaces of the mother toner particles. Specific examples of suitable particulate resins include, but are not limited to, a particulate polymethyl methacrylate having a particle diameter of 1 μm or 3 μm, a particulate polystyrene having a particle diameter of 0.5 μm or 2 μm, and a particulate poly(styrene-acrylonitrile) having a particle diameter of 1 μm. Specific examples of commercially available such particulate resins include, but are not limited to, PB-200H (from Kao Corporation), SGP-3G (from Soken Chemical & Engineering Co., Ltd.), TECHPOLYMER SB (from Sekisui Plastics Co., Ltd.), and MICROPEARL (from Sekisui Chemical Co., Ltd.).

Inorganic compounds, such as tricalcium phosphate, calcium carbonate, titanium oxide, colloidal silica, and hydroxyapatite, are also usable as dispersers.

Additionally, polymeric protection colloids are usable in combination with the above-described particulate resins and inorganic dispersers so as to more stabilize the dispersing oil droplets.

Specific examples of usable polymeric protection colloids include, but are not limited to, homopolymers and copolymers obtained from monomers, such as acid monomers (e.g., acrylic acid, methacrylic acid, α-cyanoacrylic acid, α-cyanomethacrylic acid, itaconic acid, crotonic acid, fumaric acid, maleic acid, maleic anhydride), acrylate and methacrylate monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl ether monomers (e.g., vinyl methyl ether, vinyl ethyl ether, vinyl propyl ether), vinyl carboxylate monomers (e.g., vinyl acetate, vinyl propionate, vinyl butyrate), amide monomers (e.g., acrylamide, methacrylamide, diacetone acrylamide) and methylol compounds thereof, acid chloride monomers (e.g., acrylic acid chloride, methacrylic acid chloride), and/or monomers containing nitrogen or a nitrogen-containing heterocyclic ring (e.g., vinyl pyridine, vinyl pyrrolidone, vinyl imidazole, ethylene imine); polyoxyethylene-based resins (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

The toner components liquid is dispersed in the aqueous medium using a low-speed shearing disperser, a high-speed shearing disperser, a frictional disperser, a high-pressure jet disperser, or a ultrasonic disperser, for example. A high-speed shearing disperser is preferable for controlling the particle diameter of the dispersing oil droplets into 2 to 20 μm. In this case, the revolution is preferably from 1,000 to 30,000 rpm, and more preferably from 5,000 to 20,000 rpm. The dispersing time is preferably from 0.1 to 5 minutes.

The dispersing temperature is preferably from 0 to 150° C. (under pressure), and more preferably from 40 to 98° C.

Third, an amine (B) is immediately added to the above-prepared emulsification to be reacted with the polyester prepolymer (A). The amine (B) cross-links and/or elongates molecular chains of the polyester prepolymer (A). The reaction time between the polyester prepolymer (A) and the amine (B) is preferably from 10 minutes to 40 hours, and more preferably from 2 to 24 hours. The reaction temperature is preferably from 0 to 150° C., and more preferably from 40 to 98° C. A catalyst (e.g., dibutyltin laurate, dioctyltin laurate) can be used, if needed.

Fourth, the organic solvent is removed from the emulsion after the termination of the reaction, and the resulting mother toner particles are washed and dried. The organic solvents can be removed by, for example, heating the emulsion under laminar airflow agitation. In a case where an acid-soluble or alkali-soluble compound (e.g., calcium phosphate) is used as the disperser, preferably, the mother toner particles are first washed with an acid (e.g., hydrochloric acid) or an alkali and then washed with water. Alternatively, such a disperser can be removed with an enzyme.

Fifth, a charge controlling agent is fixed on the surfaces of the above-prepared mother toner particles, and then inorganic fine particles (e.g., silica, titanium oxide) are further fixed thereon using a mixer.

Thus, a toner having a small particle diameter and a narrow particle diameter distribution is prepared. If strong shear is arbitrarily applied to the emulsion at the time the organic solvent is removed therefrom, the resulting toner shape can be arbitrarily varied, from spherical shape to rugby-ball-like shape. Additionally, the resulting toner surface morphology can also be varied, from smooth to undulate.

An alternative exemplary embodiment provides a single cartridge 150 which is detachably mountable in the image forming part 120 of the image forming apparatus 200. According to the alternative exemplary embodiment, the single cartridge 120 provides a single unit that houses the image bearing members 122Y, 122M, 122C and 122K as well as their respective parts including at least the applicators 10.

Additional modifications and variations of the present invention are possible in light of the above teachings. It is therefore to be understood that within the scope of the appended claims the invention may be practiced other than as specifically described herein.

What is claimed is:

1. An image forming apparatus, comprising:

multiple image bearing members configured to bear respective electrostatic latent images, provided in tandem;

multiple chargers configured to charge respective surfaces of the respective multiple image bearing members;

an irradiator configured to radiate light onto the charged surfaces of the multiple image bearing members to form respective electrostatic latent images thereon;

multiple developing devices configured to develop the respective electrostatic latent images with toner to form respective toner images;

an intermediate transfer member onto which the multiple toner images are transferred;

multiple primary transfer members configured to transfer the respective toner images from the respective image bearing members onto the intermediate transfer member to form a composite toner image;

a secondary transfer member configured to transfer the composite toner images from the intermediate transfer member onto a recording material;

a cleaner configured to remove residual toner particles remaining on the intermediate transfer member after transferring the composite toner image therefrom;

multiple first lubricant applicators configured to apply a first lubricant to the respective image bearing members; and a second lubricant applicator that applies a second lubricant to the intermediate transfer member, provided downstream from the cleaner and upstream from an extreme upstream image bearing member, wherein an amount of the first lubricant applied from an extreme upstream first lubricant applicator to the extreme upstream image bearing member is based on at least one of an amount of the second lubricant applied from the second lubricant applicator to the intermediate transfer member and an amount of the first lubricant applied from each of the other lubricant applicators to the respective image bearing members.

2. The image forming apparatus according to claim 1, wherein the following formula is satisfied:

$$X \leqq A + T \times (t/100) \leqq Y$$

wherein X and Y respectively represent minimum and maximum amounts of the first lubricant applied to each of the image bearing members other than the extreme upstream image bearing member from the respective first lubricant applicators, A represents the amount of the first lubricant applied from the extreme upstream first lubricant applicator to the extreme upstream image bearing member, T represents the amount of the second lubricant applied from the second lubricant applicator to the intermediate transfer member, and t represents a retransfer rate (%) of the second lubricant from the intermediate transfer member onto the extreme upstream image bearing member.

3. The image forming apparatus according to claim 1, wherein the first lubricant applied from the first lubricant applicators and the second lubricant applied from the second lubricant applicator are the same material.

4. The image forming apparatus according to claim 3, wherein the first lubricant and the second lubricant are a solidified zinc stearate.

5. The image forming apparatus according to claim 1, wherein the toner has a weight average particle diameter (D4) of from 3 to 8 μm, and a ratio (D4/D1) of the weight average particle diameter (D4) to a number average particle diameter (D1) of the toner is from 1.00 to 1.40.

6. The image forming apparatus according to claim 1, wherein the toner has a shape factor SF-1 of from 100 to 180 and a shape factor SF-2 of from 100 to 180.

7. The image forming apparatus according to claim 1, wherein fine particles having an average primary particle diameter of from 50 to 500 nm and a bulk density of 0.3 g/cm$^3$ or more are externally adhered to the toner.

8. The image forming apparatus according to claim 1, wherein the toner includes a binder resin, a colorant, and a release agent, and has a glass transition temperature of from 45 to 65° C. and a flow starting temperature of from 90 to 115° C.

9. The image forming apparatus according to claim 1, wherein the toner is prepared by subjecting a toner components liquid to a cross-linking and/or elongating reaction in an aqueous medium, said toner components liquid dispersing or dissolving a polyester prepolymer having a nitrogen-containing functional group, a polyester, a colorant, and a release agent in an organic solvent.

10. An image forming method, comprising:

charging surfaces of multiple image bearing members that bear respective electrostatic latent images, the image bearing members provided in tandem;

radiating light onto the charged surfaces of the multiple image bearing members to form respective electrostatic latent images thereon;

developing the respective electrostatic latent images with toner to form respective toner images;

transferring the multiple toner images onto an intermediate transfer member to form a composite toner image;

transferring the composite toner images from the intermediate transfer member onto a recording material;

removing residual toner particles remaining on the intermediate transfer member by a cleaner after transferring the composite toner image therefrom;

applying a first lubricant to each of the multiple image bearing members; and applying a second lubricant to the intermediate transfer member downstream from the cleaner and upstream from an extreme upstream image bearing member, wherein an amount of the first lubricant applied to the extreme upstream image bearing member is based on at least one of an amount of the second lubricant applied from the second lubricant applicator to the intermediate transfer member and an amount of the first lubricant applied to each of the other image bearing members.

11. The image forming method according to claim 10, wherein the following formula is satisfied:

$$X \leqq A + T \times (t/100) \leqq Y$$

wherein X and Y respectively represent minimum and maximum amounts of first lubricant applied to each of the image bearing members other than the extreme upstream image bearing member, A represents the amount of the first lubricant applied to the extreme upstream image bearing member, T represents the amount of the second lubricant applied to the intermediate transfer member, and t represents a retransfer rate (%) of the second lubricant from the intermediate transfer member onto the extreme upstream image bearing member.

12. The image forming method according to claim 10, wherein the first lubricant applied to the image bearing members and the second lubricant applied to the intermediate transfer member are the same material.

13. The image forming method according to claim 12, wherein the first lubricant and the second lubricant area solidified zinc stearate.

14. The image forming method according to claim 10, wherein the toner has a weight average particle diameter (D4) of from 3 to 8 μm, and a ratio (D4/D 1) of the weight average particle diameter (D4) to a number average particle diameter (D1) of the toner is from 1.00 to 1.40.

15. The image forming method according to claim 10, wherein the toner has a shape factor SF-1 of from 100 to 180 and a shape factor SF-2 of from 100 to 180.

16. The image forming method according to claim 10, wherein fine particles having an average primary particle diameter of from 50 to 500 nm and a bulk density of 0.3 $g/cm^3$ or more are externally adhered to the toner.

17. The image forming method according to claim 10, wherein the toner includes a binder resin, a colorant, and a release agent, and has a glass transition temperature of from 45 to 65° C. and a flow starting temperature of from 90 to 115° C.

18. The image forming method according to claim 10, wherein the toner is prepared by subjecting a toner components liquid to a cross-linking and/or elongating reaction in an aqueous medium, said toner components liquid dispersing or dissolving a polyester prepolymer having a nitrogen-containing functional group, a polyester, a colorant, and a release agent in an organic solvent.

19. A process cartridge detachably mountable in image forming apparatus, comprising:

multiple image bearing members configured to bear respective electrostatic latent images, provided in tandem; and multiple first lubricant applicators configured to apply a lubricant to the respective image bearing members, wherein an amount of a first lubricant applied from an extreme upstream first lubricant applicator to an extreme upstream image bearing member is based on at least one of an amount of a second lubricant applied from a second lubricant applicator to the intermediate transfer member and an amount of first lubricant applied from each of the other lubricant applicators to the respective image bearing members.

* * * * *